United States Patent [19]

Sato et al.

[11] Patent Number: 4,943,036

[45] Date of Patent: Jul. 24, 1990

[54] METHOD AND APPARATUS FOR ISOTHERMAL HOLDING OF WIRE WHEN A WIRE IS HEAT-TREATED IN-LINE

[75] Inventors: Hiroki Sato; Yoshiki Seto, both of Kanagawa, Japan

[73] Assignee: Neturen Company Limited, Tokyo, Japan

[21] Appl. No.: 262,733

[22] Filed: Oct. 12, 1988

[51] Int. Cl.[5] ..... C21D 9/64

[52] U.S. Cl. ..... 266/104; 219/155

[58] Field of Search ..... 266/102, 103, 104, 128, 266/129; 219/155, 156

[56] References Cited

U.S. PATENT DOCUMENTS

| | | | |
|---|---|---|---|
| 1,099,095 | 6/1914 | Madden et al. | 266/104 |
| 2,441,500 | 5/1948 | Miess | 266/104 |
| 3,335,260 | 8/1967 | Ferschl | 266/104 |
| 3,469,829 | 9/1969 | Fujita et al. | 266/104 |
| 4,085,922 | 4/1978 | Moreau | 266/104 |

FOREIGN PATENT DOCUMENTS

| | | | |
|---|---|---|---|
| 16-13363 | 7/1941 | Japan . | |
| 96728 | 5/1985 | Japan | 266/104 |

OTHER PUBLICATIONS

"Induction Heat Treatment of Steel", by S. L. Semiatin et al., American Society For Metals, Contents and p. 145.

*Primary Examiner*—R. Dean

*Attorney, Agent, or Firm*—Wenderoth, Lind & Ponack

[57] ABSTRACT

The present invention is drawn to a method and apparatus for holding wire at a specified temperature for a specified period of time by a direct-resistance heating device which applies such voltage as to generate Joule's heat in the wire, sufficient to offset the quantity of heat that would tend to be released from the heated wire during unforced cooling, after the travelling wire is heated rapidly to a specified temperature throughout its cross section. A temperature-holding apparatus, employed subsequent to the heating of wire, may either supply power directly to a wire through feeding wheel electrodes or entail a combination of a shell type transformer and a hollow annular holding furnace incorporating guide rollers, and having wheel electrodes electrically connected by a lead, disposed outside of the inlet and outlet of the holding furnace incorporating guide rollers, and producing secondary current in the multiple-wound wire in the furnace with the lead as a return, depending upon the holding time desired. The latter form of the apparatus imparts an advancing force and curl to the wire so that thick and inflexible wire can be placed in the holding furnace, and rollers are provided to create a desired number of turns in the wire in the holding furnace.

7 Claims, 14 Drawing Sheets

METHOD AND APPARATUS FOR ISOTHERMAL HOLDING OF WIRE WHEN A WIRE IS HEAT-TREATED IN-LINE

FIELD OF THE INVENTION

The present invention relates to a method and apparatus for holding a wire at a specified temperature for a specified period of time when said wire is submitted to heat treatment such as hardening, tempering, spherodized annealing or normalizing.

DESCRIPTION OF THE PRIOR ART

A wire made of plain carbon steel or alloy steel or the like has to be subjected to heat treatment in which the wire is held at a specified temperature for a specified period of time for the purposes of obtaining a desired metallurgical microstructure or to obtain a uniformness of said microstructure or reduce the hardness for facilitating a subsequent machining operation. The conventional heat treatment process in which wire is maintained isothermal involves a process in which the wire in a multi-wound coil weighing 500 kg, 1000 kg is charged in a bell type furnace while coiled and subjected to heating, soaking and cooling in the furnace fully isolated from the atmosphere or a wire coil is charged in a continuous furnace and subjected to required heating or heat treatment while the wire coil is conveyed at a specified speed in the furnace. The conventional method requires a long time for the uniform heating of the wire coil since the wire is multi-wound and massive as referred to above according to the conventional methods.

In-line heat treatment of wire is also known in which the wire acquires high strength based on a process of heating and cooling using an electrical means such as an induction heating or direct-resistance heating apparatus for heating the wire while the wire is made to travel as disclosed in Japanese Published Patent Appln. No. 66'-13363 (Patent No. 493490).

FIG. 1(*a*) shows a heat treatment line whereas FIG. 1(*b*) shows temperature characteristics A and B representing temperatures on the surface and core, respectively, of wire W heat-treated in said line. The wire W travelling in the direction indicated by the arrow at a speed of, say, 250 mm/sec is heated rapidly by an induction heating means C1 to a slightly higher than required hardening temperature, is heated to a uniform hardening temperature throughout the entire cross section after a soaking time, and is then quenched by cooling means Q1. This is followed by a rapid heating by induction heating means C2 to a specified tempering temperature throughout the entire cross section of the wire and a rapid cooling by cooling means Q2 to obtain a tensile strength of 1100 to 1500N/mm$^2$ throughout the entire cross section and length of the wire.

There is an analogy between the conversion technique of electrical into thermal energy as in the invention and of potential into kinetic energy in a mechanical system because when comparing heat treatment of coiled wire and heat treatment of wire in-line, say for achieving a tensile strength requirement of 1450N/mm$^2$, dispersion of said strength is in a range of 100N/mm$^2$ in case of the former and in a range of 10N/mm$^2$ for the latter, demonstrating that the latter far surpasses the former in terms of uniform quality of the products with an additional advantage of the latter being free from decarburization due to the speediness in its heating.

However, the foregoing technique is applicable only to particular types of steel and has limited applications requiring a specific mechanical property, such as high-strength wires for prestressed concrete products, due to its inflexibility in coping with hardness requirements.

Reference is made to an article by S. L. Semiatin and D. E. Stutz in "Induction Heat Treatment of Steel" (1986), American Society for Metals, page 145 in which the authors have discussed induction heat treatment of a steel bar with a diameter of 12.7 mm at a temperature of 565° C. from 50° C. where

| | |
|---|---|
| Output at source | 11 KW |
| Power density | 0.064 KW/cm$^2$ |
| Inductor length | 434 mm |
| Heating time | 17 sec |
| Feeding rate | 25.5 mm/sec |

The above conditions were set on the basis of metallurgical background material according to Grange-Baughman's tempering correlation, resulting in, however, an extremely slow processing rate.

Said wire coil weighs 0.994 kg per meter and there were two kinds of coil weighing 500 kg and 1000 kg, the heat treatment of the 500 kg coil taking about five and half hours:

$$\frac{500(\text{kg})}{0.994(\text{kg/m})} \approx 503(\text{m})$$

The heat treating time is;

$$\frac{503{,}000(\text{mm})}{25.5(\text{mm/sec})} \approx 19726(\text{sec}) \approx \text{five and a half hours}$$

A heating time of five and a half hours is too long to be efficient.

Tempering is a time consuming process as indicated by the above literature so that as far as continuous in-line hardening and tempering of wire is concerning, either a relatively long tempering time is employed by lengthening the inductor for tempering with reference to the feeding rate of wire during hardening or a device must be provided to permit different feeding rates for hardening and tempering as is shown by the graph of temperature characteristics in FIG. 2, except in a particular case in which a wire is treated to exhibit high strength as in the above patent publication.

It is extremely difficult to materialize the above alternatives.

What the above authors contemplate is to carry out tempering in a separate line in order to provide an effective tempering time t1 consisting of the heating time of 17 sec and the time over which heat is released from 565° C. as shown in FIG. 2.

The above heat treatment in a separate line also requires too much time, i.e. that required to release heat from 565° C. to a room temperature or at least to a suitable temperature for coiling, thus being subject to exceedingly low productivity.

SUMMARY OF THE INVENTION

An object of the present invention is to eliminate the difficulties with maintaining wire isothermal for a specified period of time during in-line heat treatment. An object of the present invention is also to provide a method to hold a wire at a specified temperature, precisely for a specified period of time, throughout the entire cross section of the wire travelling in-line.

It is also an object of the present invention to provide a method for preparing wires having a uniform and desired metallurgical structure or hardness throughout the entire cross section and length of the wire, and to greatly shorten the treating time as compared with the conventional methods.

Another object of the present invention is to provide a suitable apparatus to implement the method of maintaining a travelling wire isothermal. Other features and advantages of the present invention will be apparent from the following description with reference to the attached drawings.

BRIEF DESCRIPTION OF THE DRAWINGS

FIG. 9(*b*) is a sectional view taken along line A—A in FIG. 9(*a*).

FIG. 9(*c*) is a sectional view taken along line B—B in FIG. 9(*a*).

FIG. 9(*d*) is a front view showing the function of a gude unit for wire which the apparatus in FIG. 9(*a*) is provided with with.

FIGS. 10(*a*) and (*b*) are graphs showing hardness distributions over the cross sections and surfaces of wire treated according to the present invention and wire treated according to the conventional method.

DETAILED DESCRIPTION OF THE PREFERRED EMBODIMENTS

The present inventors have conducted an analysis on the basis of thermal transfer in wire (equivalent to a column) in the process of conceiving the present invention. The basic equation for heat transfer in a column (wire) is known as:

$$\frac{\partial\theta}{\partial t} = a\left(\frac{\partial^2\theta}{\partial r^2} + \frac{1}{r}\cdot\frac{\partial\theta}{\partial r}\right) \tag{1}$$

$$\text{provided that } a = \frac{\lambda}{\rho c} \tag{2}$$

where $\theta$ . . . temperature difference (K)

t . . . time a . . . thermal diffusivity ($m^2/s$)

$\lambda$ . . . thermal conductivity (W/mK)

$\rho$ . . . density ($kg/m^3$)

c . . . specific heat (J/kgK)

r . . . distance from center (m)

The initial conditions in above equation (1) are:

$$t=0,\ \theta=f(r)=\theta_0$$

where $\theta_0$ . . . initial temperature (K)

as the boundary condition heat flow density $q(\sigma)$ at r=R (radius or the surface)

$$-\lambda\frac{\partial\theta}{\partial r} = a(\theta - \theta\infty)$$

$$\frac{\partial\theta}{\partial r} + h(\theta - \theta\infty) = 0 \tag{3}$$

where $\theta\infty$ . . . peripheral temperature (K)

h . . . cooling rate ($m^{-1}$)

$$h = \frac{\alpha}{\lambda} = \frac{\text{thermal transmissivity}(W/m^2K)}{\text{thermal conductivity}(W/mK)} \tag{4}$$

When the equation (1) is substituted with the above equations (2), (3) and (4), the temperature distribution equation is:

$$\theta = (\theta_o - \theta_\infty)\Sigma\frac{2}{\mu_m}\cdot\frac{J_1(\mu_m)}{J_0^2(\mu_m) + J_1^2(\mu_m)}\cdot e^{\mu_m 2T}\cdot J_0\left(\frac{\mu_m r}{R}\right) \tag{5}$$

provided that $\mu m$ is the root of the number m of $$hR = \frac{\mu J_1(\mu)}{J_0(\mu)}$$

$T$ is given as $$T = \frac{at}{R^2} \text{ time constant}$$

The above cooling rate h and thermal transmissivity $\alpha$ are to be determined experimentally.

The inventor has conducted a series of unforced cooling tests on wires of a variety of types of steel and different diameters.

Figure 1A:
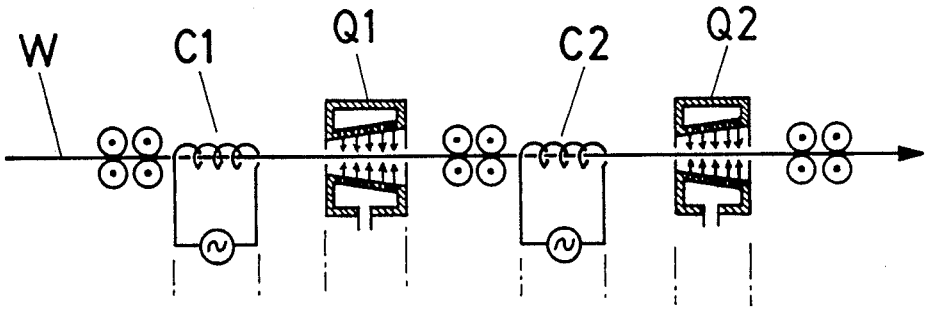
FIGS. 1(*a*) and (*b*) are a front view of a conventional in-line-heat treatment apparatus for strengthening wire and a graph showing temperature characteristics corresponding thereto, respectively.
Figure 1B:
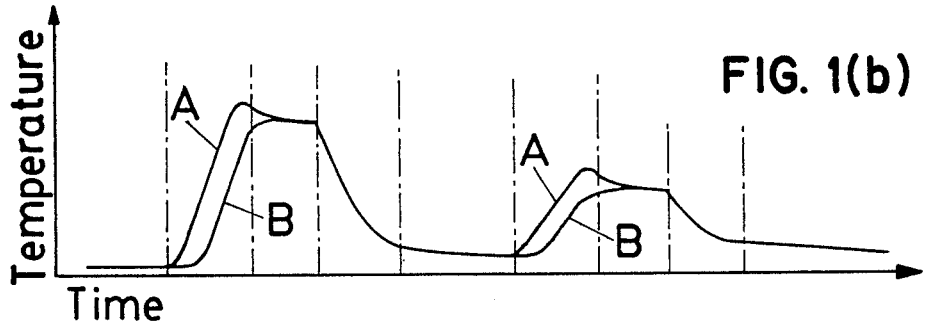
Figure 2:
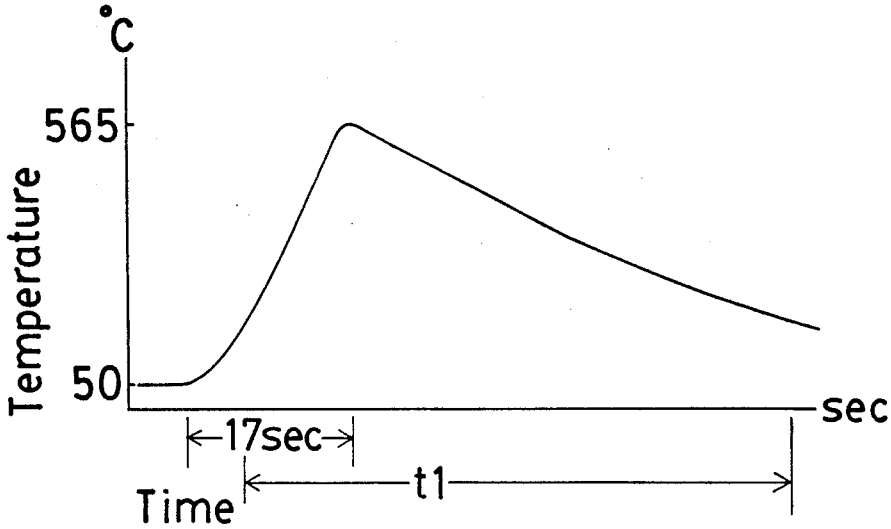
FIG. 2 is a graph of temperature characteristics of wire subjected to conventional in-line tempering.
Figure 3:
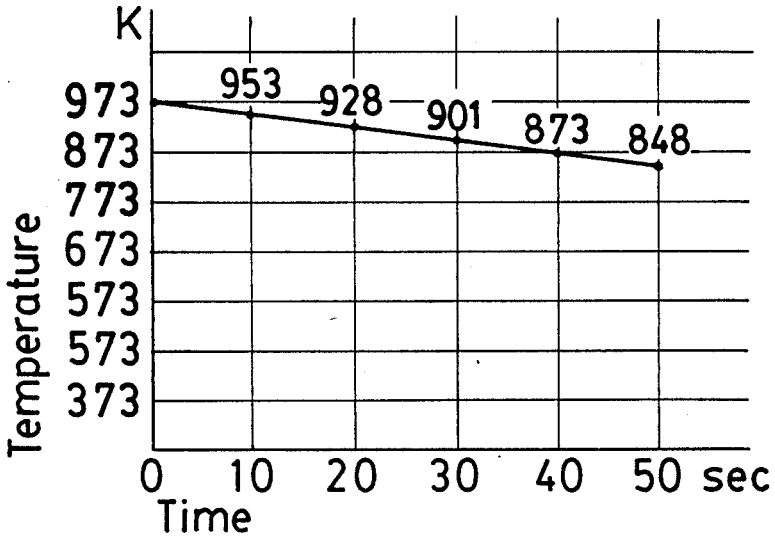
FIG. 3 is a graph of the temperature at the surface of wire during unforced cooling.

A part of said tests yielded results as follows:

The drops in the surface temperature of a workpiece having a 10 mm diameter and comprising steel equivalent to SAE 4135 heated to 973 K. and then subjected to nonforced cooling were as shown in FIG. 3.

The mean value between heat diffusivity a and heat conductivity λ of iron alloy at the temperature between 973 K. and 373 K. is known as:

$$a=9.2\times10^{-6}\ m^2/s$$

$$\lambda=40\ W/mk$$

Whereas the cooling rate of air is 0.8 at a standstill and 2 under severe turbulance, the travelling wire is assumed to be at about 1.

The inventor has conducted an analysis employing a computer of the temperature distributions on the cross section of the wire at each successive point of a specified period of time after the start of nonforced cooling, putting values such as measured values of drops in the surface temperature of wires having various diameters yielded by above experiment of nonforced cooling, the means value between the above heat diffusivity a and heat conductivity λ and the above air cooling rate h=1 into the above equation of temperature distribution.

Figure 4:
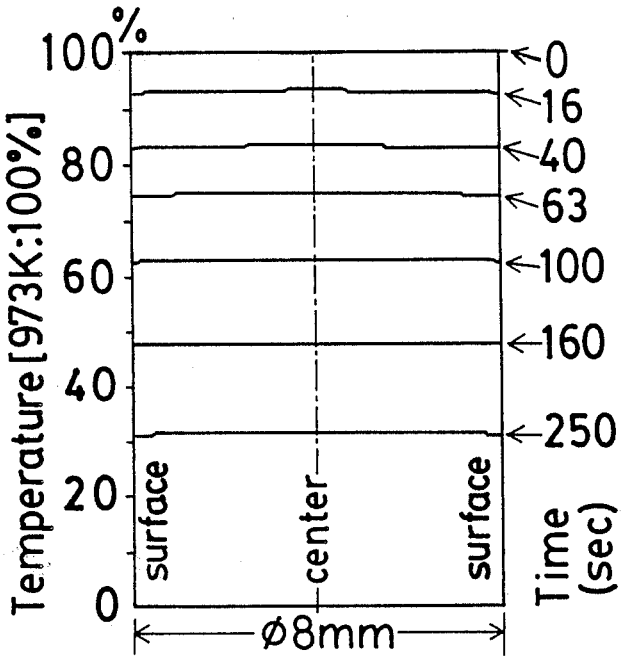
FIGS. 4(*a*) to (*d*) are graphs showing an analysis conducted with a computer of the temperature distributions over the cross section of wires per unit time when wires having different diameters are subjected to unforced cooling.
Figure 4:
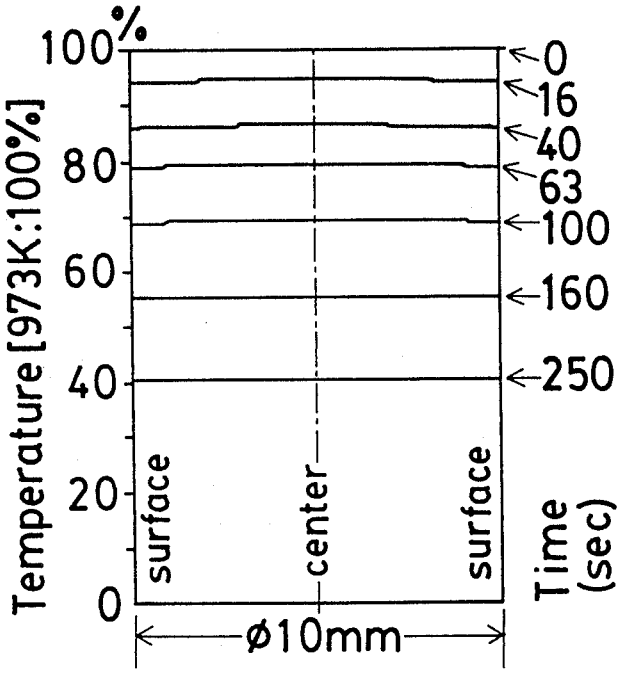
Figure 4:
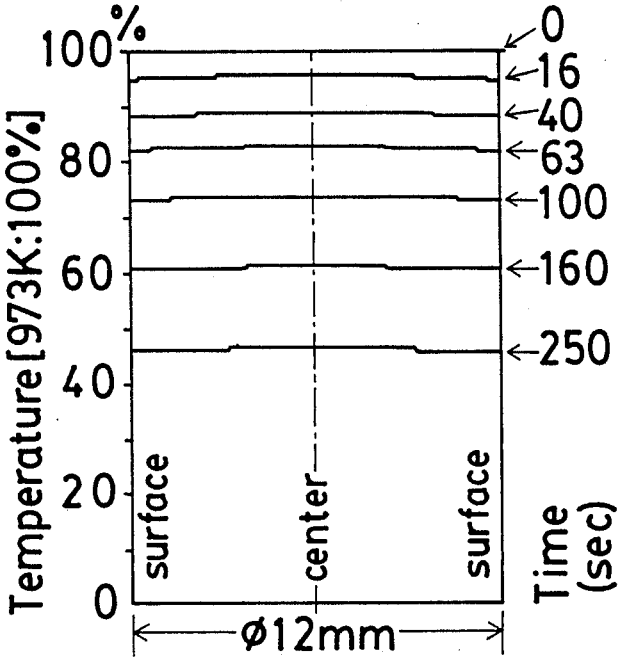
Figure 4:
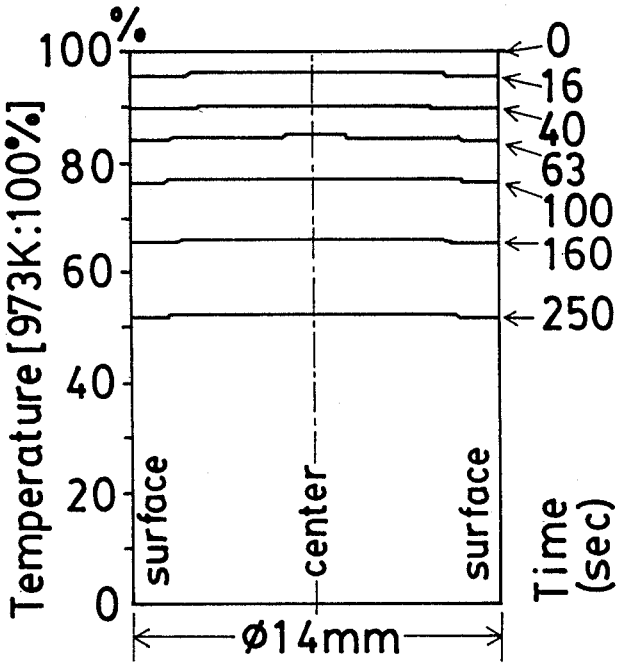

FIGS. 4(*a*) to (*d*) illustrate a part of the above analysis. The experiments have been conducted on the wires the material of which is equivalent to SAE 4135 with diameters of 8 mm, 10 mm 12 mm and 14 mm, respectively, for (a) to (d) in said figure, and an analysis has been made according to the above procedure using data of the surface temperature measurements when the wire was subjected to unforced cooling after being heated to 973 K. throughout the entire cross section.

As a result, a very remarkable effect has been observed in that so far as the wires with the diameters of 8 to 14 mm are concerned, the difference in temperature drops due to nonforced cooling between the surface and the core is so slight as to be negligible or the surface temperature measured is approximately equal to the temperature distribution throughout the entire cross section.

Now turning to the object of the present invention, the ultimate purpose of the invention is to offer a heat treatment of wire by maintaining the wire isothermal for a specified period of time to obtain a desired metallurgical structure and uniformness of the structure throughout the entire length and cross section or to soften wires so as to be easily worked in the subsequent operation as described above.

Under the conventional process, one has had to resort to furnace heating for holding a wire at a given temperature for a given period of time although such is not free from the shortcomings described above. In-line-heating permits wire to be held isothermal for a very short period of time but hardly permits a travelling wire to be held at a given temperature for as long as conventional furnace heating.

The inventors attach great importance to the quality of heat treatment and therefore have rejected furnace heating on this ground and have decided to employ in-line-heating.

In order to shorten the isothermal holding time during in-line-heating, a series of experiments have been conducted to seek the shortest holding time in pursuit of how the structure and hardness of the wire heated throughout the entire cross section varies with respect to heating temperature and holding time.

An example is given as follows:

A test specimen hardened throughout the entire cross section thereof (steel equivalent to SAE 4135 with a 10 mm diameter) is heated throughout the entire cross section thereof to 973, 1003, 1033 K., respectively, over an isothermal holding time of 0, 5, 10, 20, 100 and 500 sec and the resulting metallurgical structures and hardnesses have been studied.

Figure 5:
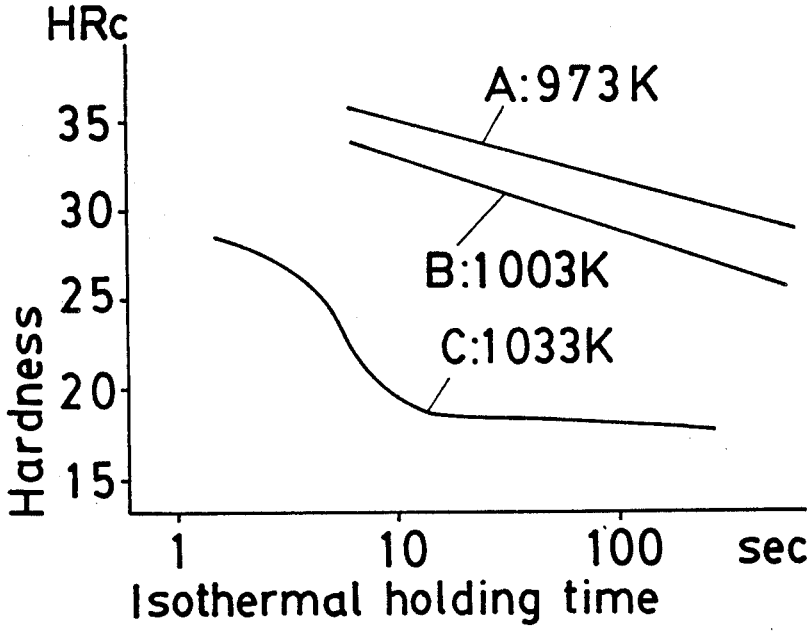
FIG. 5 is a graph showing the relation between isothermal holding time and hardness when workpieces to be hardened are tempered under different tempering conditions (heating temperature, holding time).
Figure 6A:
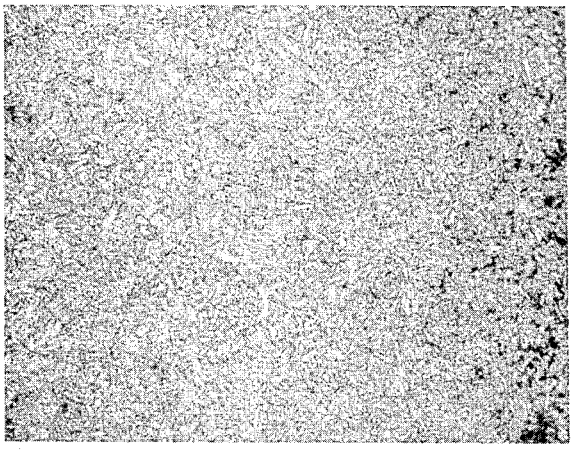
FIGS. 6(*a*) to (*i*) are microscopic photographs of metallurgical structures of the tempered workpieces under different tempering conditions.
Figure 6B:
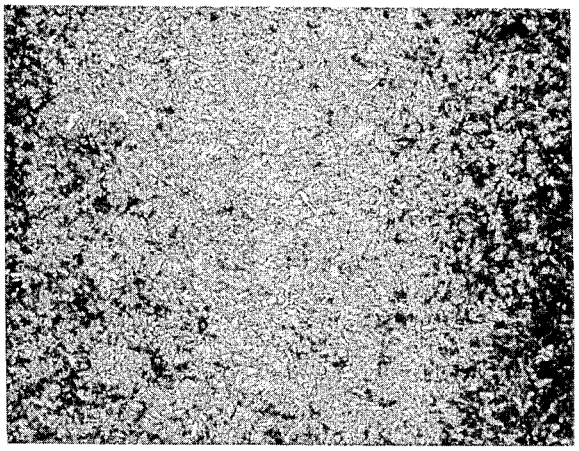
Figure 6C:
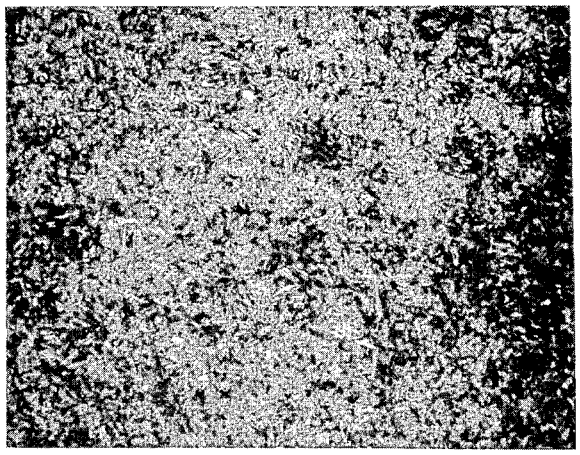
Figure 6D:
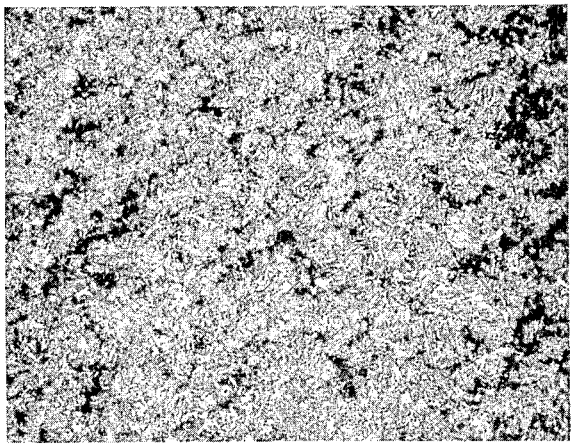
Figure 6E:
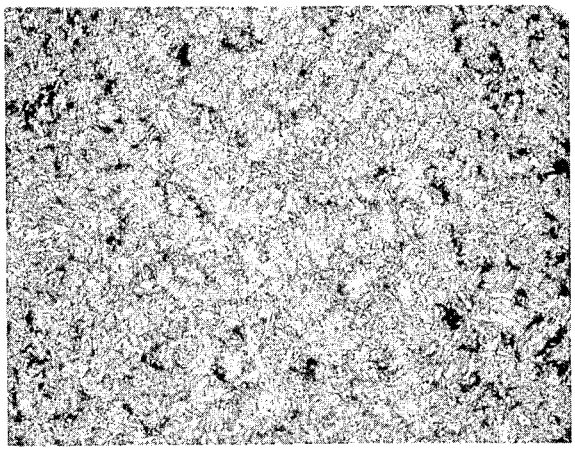
Figure 6F:
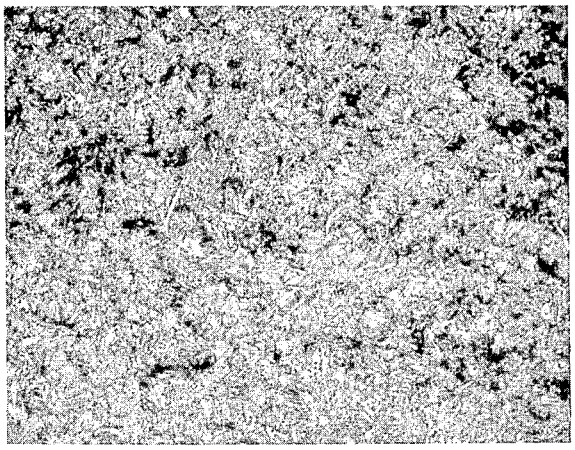
Figure 6G:
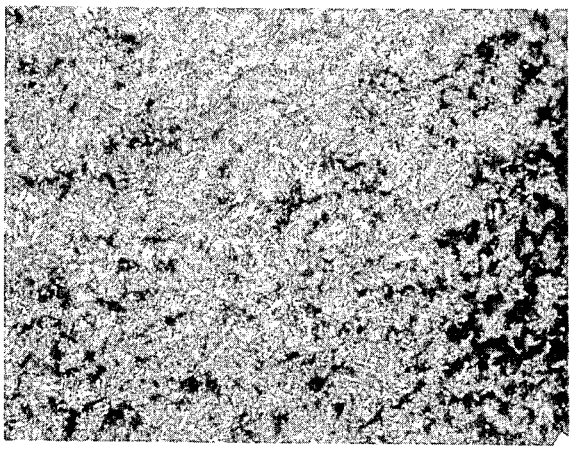
Figure 6H:
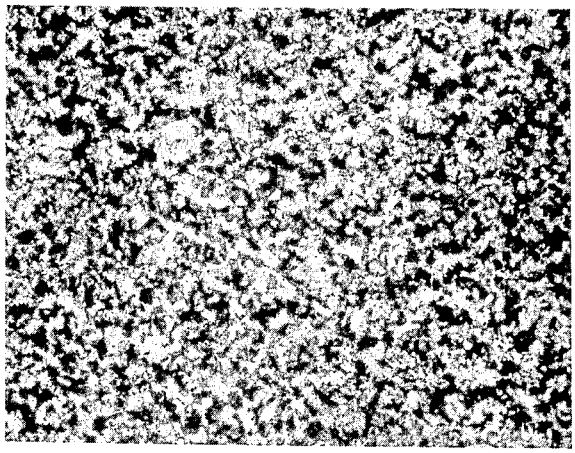
Figure 6I:
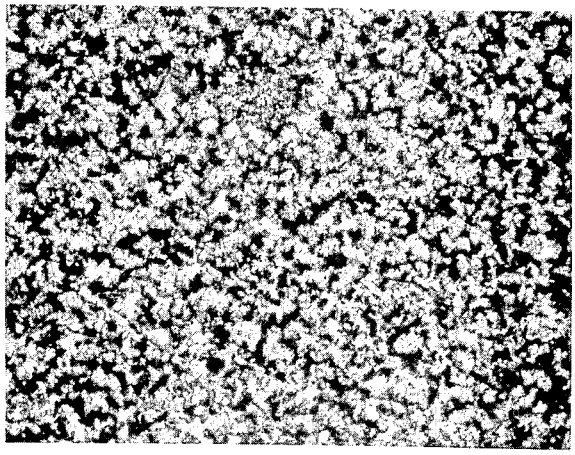

The test results are shown in FIG. 5 in a graph of the relation between the isothermal holding time and the hardness of specimens at three different temperatures, that are at 973 K. for line A, at 1003 K. for line B and at 1033 K. for line C. FIGS. 6(*a*) to (*i*) are microscopic photographs of the metallurgical structures (magnified 400 times) of the specimens heated to 973 K. for (a) to (c), to 1003 K. for (d) to (f), to 1033 K. for (g) to (i) for holding times of 0 sec, 100 sec and 500 sec for each.

From an analysis of the above FIGS. 5 and 6, it has been found that the structure turns into ferrite-perlite in a very short period of time when the heating temperature is high whereas the structure is in tempering martensite but the hardness is less reduced when the holding temperature is lower. Therefore, it has been made clear that the length of isothermal holding time, apart from the heating temperature, helps to reduce hardness without any change in the structure whereas heating temperature affects a change in structure more than holding time.

It has also been ascertained through a variety of experiments that the relation between the heating temperature and the shortest limit of holding time can be found from experiments to be conducted before a material is maintained isothermal in order to prepare the structure and impart a hardness thereto as required.

To be definite, the longest holding time of 500 sec provides a very low finished hardness HRc25 and a holding time of at least 50 sec readily provides a finish hardness of HRc 30, the most common hardness requirement when hardness is to be reduced without any change in structure.

The next problem is associated with the feeding rate of wire during in-line-heating.

Assuming that the isothermal holding time takes 100 sec for meeting a typical hardness requirement, it has been concluded that a length of 10 m of a travelling wire is to be held isothermal when the feeding rate of the wire is at 100 mm/sec whereas a length of 5 m is to be held isothermal at a feeding rate of 50 mm/sec.

This may lead to the question of why conventional furnace heating takes so much time.

The reason why may be attributed to the characteristics of the conventional furnace heating process in which said heating takes a long time for heating the furnace atmosphere up to a specified temperature and imparts heat to the wire surface only.

The inventors have developed the present invention based on the analysis and study of the state of energy impartation in the above furnace heating and of the foregoing heating and cooling processed.

The present invention is characterized by:

(1) A wire is subjected to heat treatment by isothermal heating at a specified temperature for a specified period of time.

(2) The said heat treatment is carried out in-line.

(3) The wire continuously fed is heated to the above specified temperature or to slightly higher than said specified temperature throughout the entire cross section by a rapid heating means.

(4) Voltage by a direct-resistance heating apparatus is applied to the wire for a specified period of time.

(5) The above voltage is so set that Joule's heat developed in a wire by said voltage offsets the quantity of heat released during unforced cooling of the heated wire.

Based on the finding that the temperature distribution of the entire cross section of wire during unforced cooling shows a uniform drop in temperature nearly identical to a drop at the surface that is capable of measurement, the present invention is such that Joule's heat generated by direct-resistance heating means to generate heat throughout the entire cross section of wire is applied to offset said drop in temperature.

Figure 7:
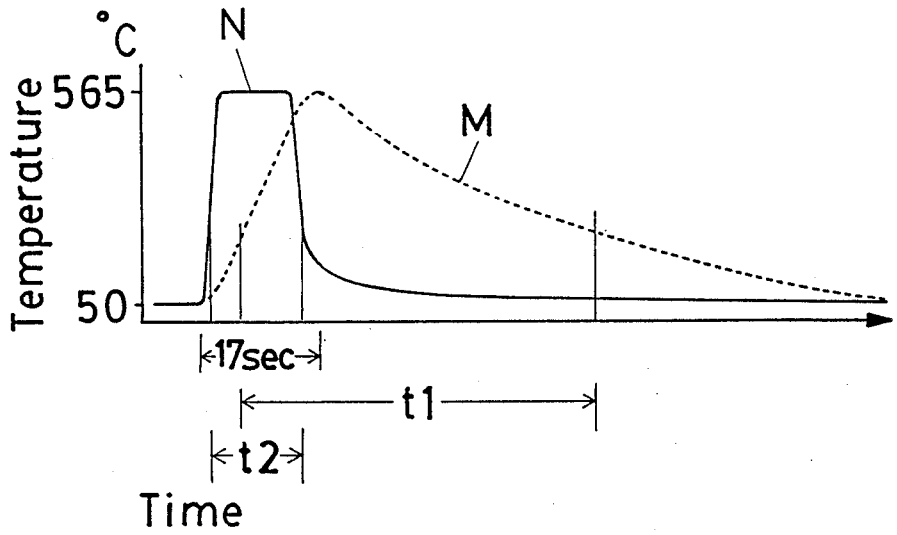
FIG. 7 is a graph of temperature characteristics showing the principle behind the present invention.

Therefore, the normally time-consuming effective tempering time t1, including the highest temperature of 565° C. in the above literature, as shown by dotted line M in the temperature characteristics graph of FIG. 7 can be reduced to t2 shown by line N according to the present invention, resulting in a far shorter treating time, and a precise as well as reliable maintaining of wire isothermal throughout the entire cross section of the wire.

Figure 8:
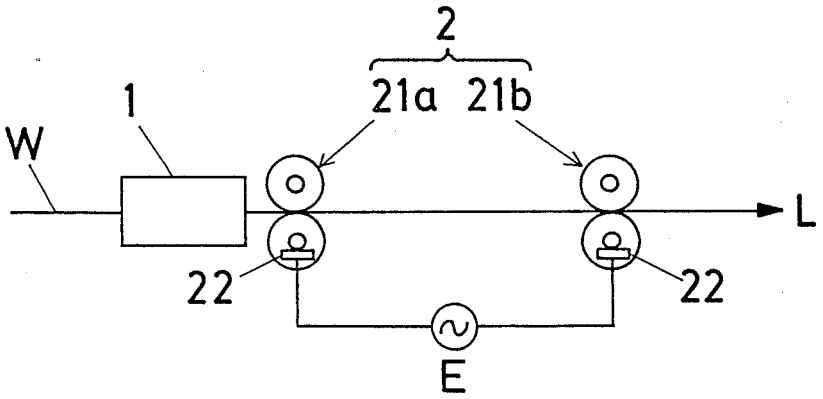
FIG. 8 is a front view of one embodiment of an apparatus according to the present invention.
Figure 9A:
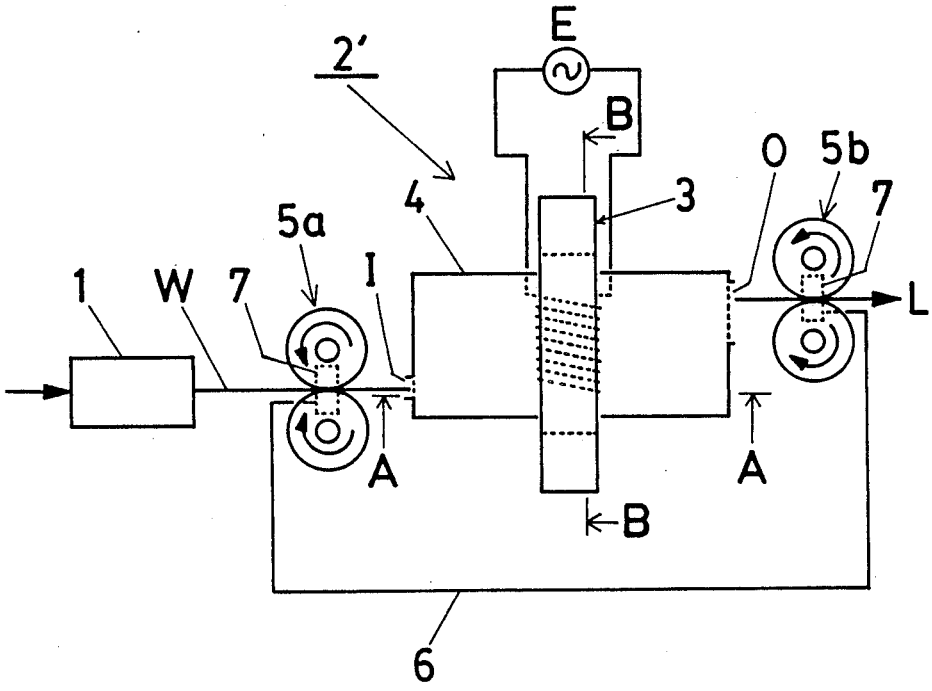
FIG. 9(*a*) is a plan view of another embodiment of an apparatus according to the present invention suitable for providing a longer isothermal holding time.
Figure 9B:
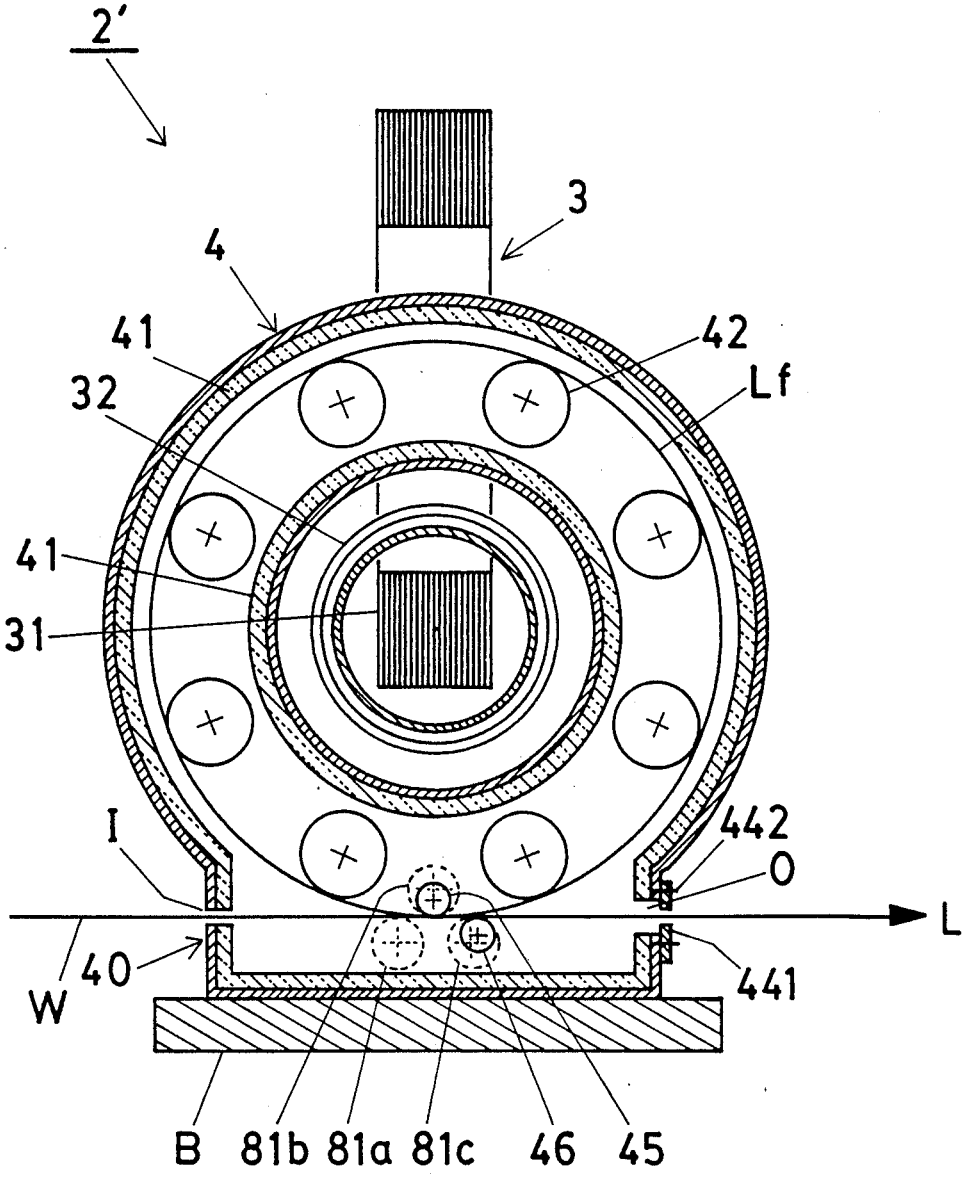
Figure 9C:
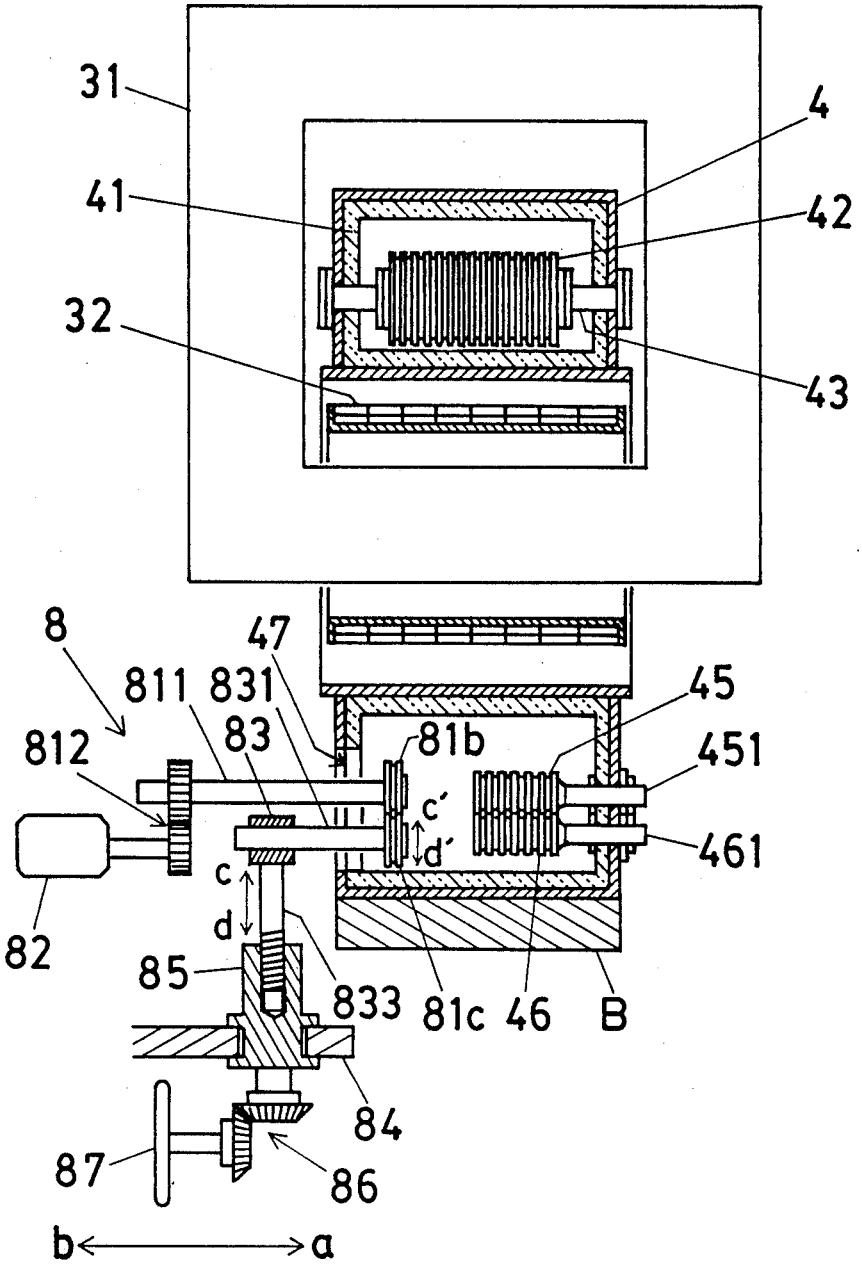
Figure 9D:
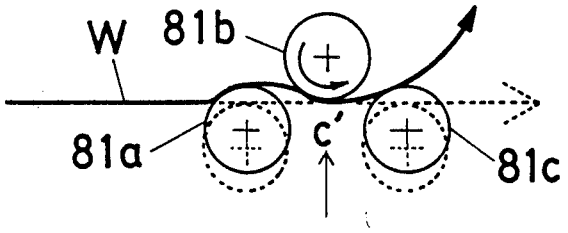

A detailed description of a heat treating line employing an apparatus embodying the present invention is made with reference to FIG. 8.

Reference L in the figure denotes a heat treating line in which a wire travels in the direction indicated by the arrow at a specified rate.

An apparatus embodying the present invention comprises a rapid heating means 1 disposed on the heating line L and a temperature-holding apparatus 2 comprising a direct-resistance heating means employing feeding wheel electrodes 21*a* and 21*b* to be in contact with the travelling wire W in line L.

The rapid heating apparatus 1 comprises a direct-resistance heating or induction heating apparatus capable of performing rapid heating wherein a travelling wire W is heated to a predetermined holding temperature by direct-resistance heating or is heated to slightly higher than a predetermined holding temperature at the surface thereof by induction heating, and is then kept uniformly at a predetermined holding temperature throughout the entire cross section until wire W reaches the temperature holding apparatus 2.

The temperature-holding apparatus 2 is fed from a power supply E via sliders 22 and 22 to be in contact with feeding wheel electrodes 21*a* and 21*b* comprising, for an example, opposed conductive rolls.

Although the arrangement itself is known in the art and constitutes an essential part of the present invention, what makes the present invention radically different from the prior art is the spacing between feeding wheel electrodes 21*a* and 21*b* and the setting of the applied voltage.

The spacing between feeding wheel electrodes 21*a* and 21*b* is set with respect to the isothermal holding time to be determined by the feeding rate of the travelling wire W on the line L and the purpose of heat treatment, constituting an important feature of the present invention.

The voltage applied to wire W travelling between the feeding wheel electrodes 21*a* and 21*b* is so set as to generate so much heat due to Joule's heat as to offset the heat release from wire W while it passes between said feeding wheel electrodes 21*a* and 21*b*, constituting another important feature of the present invention.

A detailed description of the above two elements will be made referring to the apparatuses embodying the invention.

In the above apparatus embodying the invention, when the spacing between feeding wheel electrodes 21*a* and 21*b* is a little too much, a roll or a plurality of rolls for support, made of nonconductive and heat resistant materials may be disposed rotatably along the heating line to permit heated wire W to travel linearly.

Another embodiment of the invention suitable for providing a relatively longer isothermal holding time is shown in FIGS. 9(*a*) to (*c*).

FIG. 9(*a*) is a schematic plan view of the apparatus wherein reference numeral 1 denotes a rapid heating apparatus similar to the above embodiment, and 2' a temperature holding apparatus comprising a direct-resistance heating means of the secondary current conducting type. Reference numeral 3 in said temperature-holding apparatus 2' denotes a transformer electrically connected to power supply E.

Reference numeral 4 denotes a holding furnace, whereas 5*a* and 5*b* denote wheel electrodes.

Reference numeral 6 denotes a conductor for connecting electrically said wheel electrodes 5*a* and 5*b* via, for instance, sliders 7.

Said transformer 3 is, for example, a shell type transformer of which annular core 31 is wound with a primary coil 32 connected to a power supply E as shown in FIGS. 9(*b*) and (*c*) with end faces normal to the heat treating line L disposed on a stand (not shown).

The holding furnace 4 is a hollow annulus with the end face thereof being parallel to heat treatment line L, resting secured on a base B with an iron core 31 in the above transformer 3 extending through the anullus.

The inside of the hollow annulus of the holding furnace 4 is lined with heating insulation 41 and in the space enclosed by the heat-insulation 41 a plurality of guide rollers 42 are disposed at specified radial intervals.

Each guide roller 42 is capable of turning on the periphery of a shaft member 43, directed normal to the heat treatment line L, and supported by the furnace wall.

Guide rollers 42 are made of nonconductive and heat resistant materials, for instance, ceramics having a serrated or corrugated periphery to contain the wire in each trough.

Holding furnace 4 is provided with a bulge section 40 at its lower portion or at the portion contacting base B, bulge section 40 containing the plane in which wire W travels, inlet I and inlet O as shown in FIG. 9(*a*). The relative position of holding furnace 4 and an iron core 31 in transformer 3 is such that a circle formed by connecting the peripheries of said guide rollers 42 is tangent to the travelling plane, in the lowest position of wire travelling path Lf in the furnace. Wire W led into the furnace from inlet I is transferred along wire path Lf in the furnace from the inlet side to the outlet side successively as the rollers turn.

Located in said bulge section 40 are rollers 45,46 for the discharging of wire W disposed proximate the furnace wall on outlet O side, made of nonconductive and heat resistant material.

Roller 45 is so arranged that its peripheral lower side contacts the lowest position of wire path Lf in the furnace whereas roller 46 is so arranged as to contact, at its peripheral upper side, the plane in which wire W travels at a location nearer to outlet O than roller 45. The rollers 45,46 travel while rotating on the peripheral surface of shaft members 451 and 461 supported by the furnace wall, respectively.

The peripheries of both rollers 45 and 46, over a specified length, have serrated or corrugated surfaces to each define a trough which accommodates the wire.

The outlet O is oblong, corresponding to the length of said roller 46, and permits the wire to be guided from roller 46 to be discharged from outlet O, not permitting the wire to travel further through wire path Lf in the furnace when wire W has undergone a specified number of turns through wire path Lf in the furnace.

Outlet O is closed during heat treatment, by a cover 441 with bolts 442 disposed over its opening except at one portion thereof through which wire W is discharged.

The shown embodiment is provided with a wire-guide unit 8.

Said wire-guide unit 8 comprises rollers 81*a* to 81*c* and a mechanism to provide each roller 81*a* to 81*c* with given functions. k Said wire-guide unit 8 is capable of being transferred on a truck (not shown) in the direction indicated by arrow a-b and is moved in the direction a for moving moving said rollers 81*a* to 81*c* into the furnace through opening 47 provided on the furnace wall on the inlet side of bulge section 40 for placing wire W into said furnace 4 prior to carrying out the heat treatment operation, and is transferred in the direction b when the wire placement is completed. Said opening 47 is closed by a cover (not shown) during the heat treatment operation.

Said roller 81*b* is secured to one end of shaft member 811 so as to be disposed in the wire path extending from inlet I at the periphery by being tangential to the lowermost position of wire path Lf in the furnace when it moves in the direction a.

The other end of said shaft member 811 is connected to driving source 82 through transmission mechanism 812 so that roller 81*b* is rotatable.

When said unit 8 is moved toward a, each said roller 81*a* and 81*c* is positioned below the path of wire W entering the furnace from inlet I and rotates around the periphery of shaft member 831 and 831 with an elevator 83 serving as a common supporting member.

Said elevator 83 is movable vertically by means of for instance, a mechanism to be described later, but is not rotatable due to a checking member (not shown). The elevator 83 is supported on the top face of shaft member 833. A thread provided on the lower surface of shaft member 833 is screwed in the internally threaded opening in rotating element 85 rotating element 85 is connected to a handle 87 through, for instance, bevel gear set 86 or the like so that the rotating element 85 rotates as said handle is turned, and the length of shaft members 833 exposed from rotating element 85 changes as rotating element 85 rotates.

The elevator 83 thus moves vertically as indicated by arrow c-d so that rollers 81*a* and 81*c* mounted on the periphery of shaft members 831, 831 carried on the elevator 83 are capable of being moved together vertically as indicated by arrow c'-d'.

Wire-guide unit 8 is provided because the wire W subjected to heat treatment under the present invention can tend to be rather inflexible due to its relatively large diameter, and high hardness due to its being already hardened in certain cases. The wire W treated by the present invention is different from copper or aluminum wire manufactured by cable manufacturers.

When wire W is to be placed in holding furnace 4 prior to carrying out the heat treatment operation, wire-guide unit 8 is moved in the direction a, the roller 81*b* is driven to rotate in the direction indicated by an arrow as shown in FIG. 9(*d*), and the upper peripheries of the rollers 81*a* and 81*c* are arranged slightly above the wire path by operating handle 87. The front end of wire W entering from inlet I abuts against the upper periphery of roller 81*a* so as to deviate upward and then abuts rotatably-driven roller 81*b* so as to deviate downward and, under an advancing force imparted thereto, the advancing wire W then abuts the upper periphery of roller 81*c* to deviate upward so that said wire W is made to curl and conform to wire path Lf in the furnace. Wire-guide unit 8 is not required after the start of the heat treatment operation since the wire W on the way to holding furnace 4 is heated by rapid heating apparatus 1 and becomes flexible and is tensioned by a wire-feeding mechanism (not shown).

Said wheel electrodes 5*a* and 5*b* are disposed respectively, outside and proximate inlet I and outlet O of the holding furnace. Each wheel electrode 5*a* and 5*b* has a pair of opposed conductive rolls with their peripheries spaced a given clearance and are rotatable while holding travelling wire W therebetween.

Either one or both of said electrodes 5*a*, 5*b* have to be electrically connected by a lead 6 with, for instance, a slider 7 serving as an electrical connecting means between lead 6 and rotating wheel electrodes 5*a*, 5*b*.

In the isothermal holding apparatus having the above-described structure, prior to heat treatment, wire W is wound a specified number of turns in holding furnace 4 in temperature-holding apparatus 2' using wire-guide unit 8 after the wire W has passed through the rapid heating apparatus 1 and other apparatuses such as cooling unit, straightener and other unit (not shown) to a coiler prior to the wire W being made to travel and power being fed from power source E.

In this state, a plurality of turns of wire W pass through annular core 31 in transformer 3 and as wire W travels in contact with wheel electrodes 5*a* and 5*b* disposed respectively outside of inlet I and outlet O, the secondary voltage is induced in wire W by said conduction of current, which secondary current flows in wire W between wheel electrodes 5*a* and 5*b* with lead 6 as a return, and the wire W generates Joule's heat throughout the entire cross section thereof.

Whereas the electrical power to generate heat in wire W is specified to offset the heat that would be from said wire W during unforced cooling, the heat release loss is reduced due to a rise in temperature in the furnace as the continuous operation proceeds because of the heat generation in the holding furnace 4 so that the power can be reduced after a specified lapse of operating time thereby contributing to a reduced running cost.

The setting of the voltage to be applied to wire W by temperature-holding apparatus 2 or 2' according to the method of the present invention is as follows:

An example of a computation of the temperature when wire W heated by rapid heating apparatus 1 to, for instance, a temperature of 973 K. throughout the entire cross section is held at said temperature is:

Quantity of heat release q is as known $$q=\alpha(\theta-\theta\infty) \tag{6}$$

where q . . . quantity of heat release per unit area ($W/m^2$)

$\alpha$ . . . thermal transmissivity ($W/m^2$ K)

$\theta-\theta\infty=973$ K. $-273$ K. $=700$ K.

cooling rate h is as described above $$h = \frac{\alpha}{\lambda} = \frac{\text{(thermal transmissivity)}}{\text{(thermal conductivity)}}$$

when above equation (6) is substituted with thermal conductivity $\lambda=40$ W/mK cooling degree $h=1$ $m^1$ of the foregoing iron alloy $$\alpha = 40W/mK \times 1 \times \frac{1}{m} = 40W/m^2\,K$$

accordingly $$\begin{aligned} q &= 40W/m^2\,K \times 700K \\ &= 2.8 \times 10^4\,W/m^2 = 2.8W/\text{cm}^2 \end{aligned}$$

On the other hand, the quantity of heat release q is offset by the generation of Joule's heat due to direct-resistance heating to hold the wire at a specified temperature according to the present invention so that the equation to obtain the quantity of heat generation $I^2$ R due to resistance R of flowing current I corresponding to the side quantity of heat release q when the unit length is 1 m;

$$\pi d[m]q[W/m^2] = I^2(A^2) \times \rho[\Omega - m] \times \frac{1[m]}{\frac{\pi}{4}\,d^2[m^2]} \quad (7)$$

accordingly $$I = \frac{\pi}{2}\left(\frac{q}{\rho}\right)^{\frac{1}{2}} d^{\frac{3}{2}} \quad (8)$$

where d . . . diameter [m]

p . . . resistivity rate [Ω−m]

The following values have been obtained experimentally: resistivity $\rho=90\times10^{-8}$[Ω−m]

where material SAE 1045, 973 K. and the value obtained experimentally as an approximation, and quantity of heat release $q=3\times10^4$ W/m$^3$ when these values are substituted into Equation (8)

$$\begin{aligned} I(A) &= \frac{\pi}{2}\cdot\frac{q}{\rho}\,d^{\frac{3}{2}} = \frac{\pi}{2}\cdot\frac{3\cdot10^4}{90\cdot10^8}\,d^{\frac{3}{2}} \\ &= 286.786d\,(m)^{\frac{3}{2}} \end{aligned}$$

The above equation shows that current value I amounts to $d^{3/2}$ independent of the feeding rate of wire W.

The isothermal holding time is determined with regard to the relation between holding temperature and time to obtain a desired metallurgical structure and hardness based on the example above.

Accordingly, the shortest holding time is found experimentally prior to carrying out the heat treatment operation so that it is possible to set the spacing between feeding wheel electrodes 21*a* and 21*b* in temperature-holding apparatus 2 and also to select the wire length corresponding to the number of turns between wheel electrodes 5*a* and 5*b* in temperature holding apparatus 2' according to the purpose of treatment.

Figure 10A:
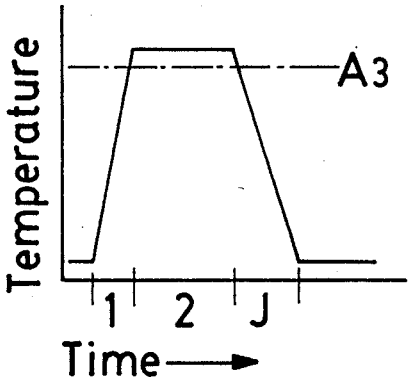
FIGS. 10(*a*) and (*c*) are graphs showing the relation between rapid heating apparatus, temperature holding apparatus and wire temperature conditions.
Figure 10B:
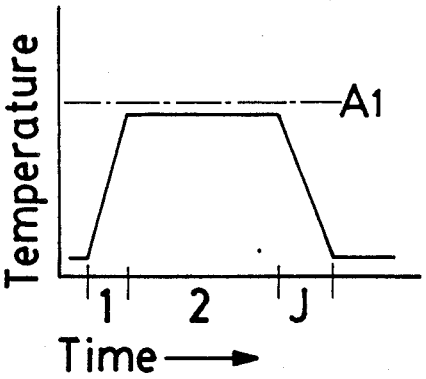
Figure 10C:
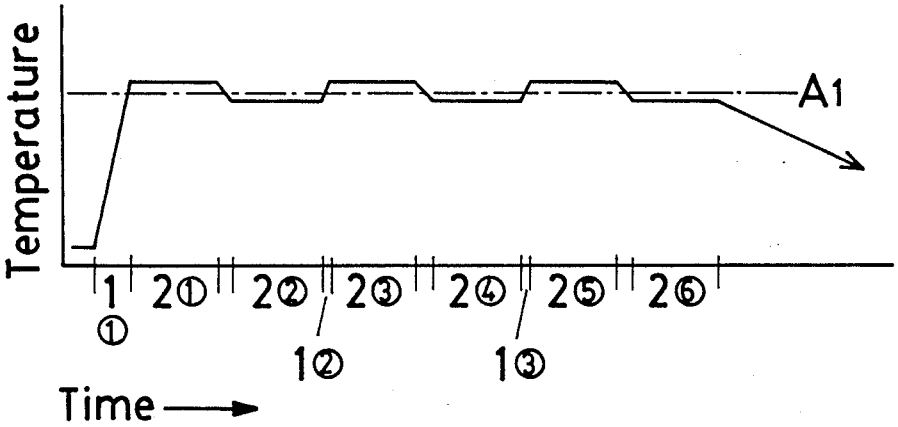

The heat treatment line according to the present invention is represented in FIGS. 10(*a*) to (*c*) in which either direct-feeding type or secondary-current-feeding type lines are used according to the length of isothermal holding time. In each Figure, the curve representing the temperature of travelling wire is shown in graph form with temperature defined along the ordinate and time defined along the abscissa.

Reference numeral 1 in the figure denotes a rapid heating apparatus whereas 2 (including 2') denotes a temperature holding apparatus and J a cooling jacket.

FIG. 10(*a*) illustrates the hardening of wire wherein a wire is heated rapidly above the transformation point $A_3$ by rapid heating apparatus 1, is isothermally held for a specified period of time by temperature-holding apparatus 2, and is then cooled rapidly by cooling jacket J.

FIG. 10(*b*) illustrates the tempering of wire in which wire is heated below the transformation point A1 by rapid heating apparatus 1, is held isothermally for a specified period of time by temperature-holding apparatus 2, and is then subjected to cooling by cooling jacket J.

According to the present invention is is quite feasible to carry out hardening as well as tempering in a single line with temperature-holding apparatus 2 and 2'. FIG. (10(*c*) illustrates the spherodized annealing of wire wherein wire is, as is shown, heated to just above the transformation point A1 by rapid heating apparatus 1①, is held at said temperature for a specified period of time by temperature holding apparatus 2①, is cooled by, for instance, unforced cooling to a temperature just below the transformation point A1, which temperature is maintained for a specified period of time by temperature-holding apparatus 2②, and is then heated up again to a temperature just above the transformation point A1 by rapid heating apparatus 1②, which temperature is maintained for a specified period of time by temperature-holding apparatus 2③. The above process is repeated several times before the wire is gradually cooled.

Apart from the above, for instance, for annealing stainless steel wire the process in FIG. 10(*a*) is applicable.

For carrying out oxygen-free heat treatment in the apparatus in FIG. 8, wire travelling line L is sheathed concentrically between feeding wheel electrodes 21*a* and 21*b* with a pipe having a specified inside diameter, the pipe being filled with inert gas whereas in the apparatus in FIG. 9, holding furnace 4 is filled with an inert gas for providing a non-oxidation atmosphere.

It is preferable to dispose a flaw detector and a marker to mark the flaw found by the detector in-line, for instance, proximate the end of the line where the heat-treated wire is coiled, for permitting the flaw on the wires to be noticed readily, thus allowing the flaws to be coped with upon the carrying out of subsequent processes on the wire subjected to heat treatment.

A variety of heat treatment processes require isothermal holding apart from the above heat treatment. An example of an experiment of thermal refining according to the present invention is given below:

[Experiment]

*Wire: equivalent to SAE 1045
diameter 10 mm
*Heat treatment:
Wire feeding rate: 80 mm/sec
Hardening: The wire was heated to 1253K throughout the entire cross section thereof by induction heating and then was quenched with tap water.

-continued

| [Experiment] | |
|---|---|
| Tempering: Rapid heating apparatus 1 (induction heating) heated the wire rapidly and uniformly up to 983K throughout the entire cross section thereof and the temperature was held isothermally by temperature-holding apparatus 2' subject to the following conditions, and was later cooled with tap water: | |
| Isothermal holding length | 8 m |
| Voltage applied | 27 V |
| Current | 286A |
| Isothermal holding time | 100 sec |
| Hardness to be achieved | HV270 (HRc25) |

*The above heat-treated wires were subject to hardness tests.

Figure 11A:
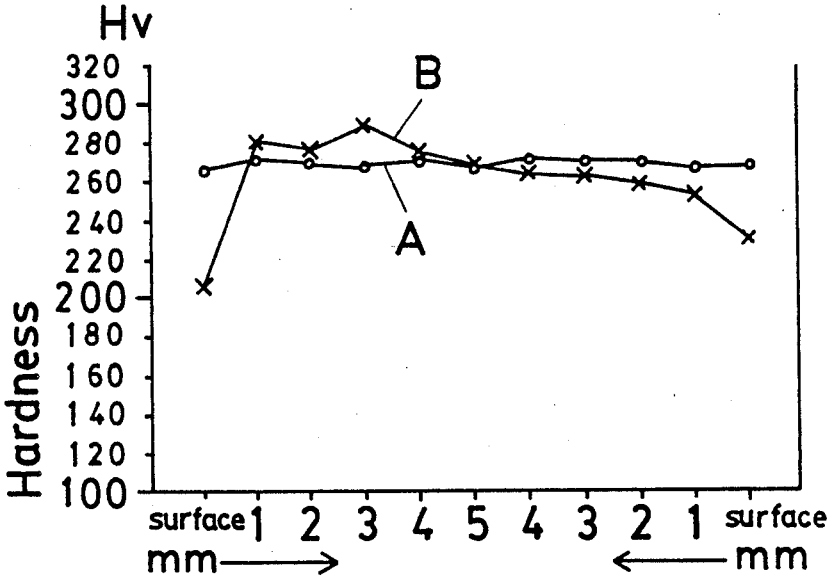
Figure 11B:
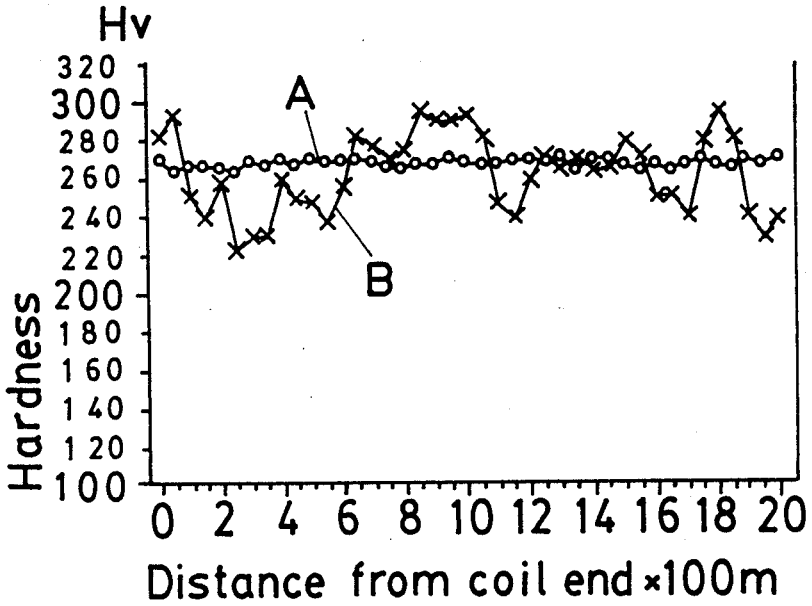

The test results are shown in a graph of hardness distribution in FIGS. 11(*a*) and (*b*) together with the test results of a workpiece subjected to hardening and tempering in a conventional furnace.

FIG. 11(*a*) shows the hardness distribution over the cross section of wire whereas FIG. 11(*b*) shows the same at the surface of the wire in the longitudinal direction, with line A representing a workpiece subjected to heat treatment according to the present invention and line B representing the workpiece heat-treated in a conventional furnace.

It has been demonstrated in the above that the process according to the present invention allows the hardening and tempering operation to be carried out in a far shorter time than in conventional furnaces with a remarkably uniform hardness distribution throughout the cross section of wire W as well as in the longitudinal direction of wire W. Thus, the marked advantageousness of the present invention over the conventional methods are obvious from the above results.

The present invention permits a wire to be held at a specified temperature for a specified period of time throughout the entire cross section thereof during in-line-heat treatment as described above, and allows the holding time to be kept to a minimum, thus eliminating a problem associated with a very long heat treatment line eliminating the risk of decarburization, providing uniform structure and hardness throughout the entire cross section as well as over the length of the wire, and permitting a flaw on the material wire to be detected readily for marking, resulting in an outstanding improvement in the quality of heat-treated wires.

The apparatus according to the present invention, particularly the temperature-holding apparatus of the secondary-current-feeding type, is also applicable to wires having a large diameter or low flexibility and ensures that a specified length of wire is maintained isothermal within a furnace for a specified period of time with respect to the feeding rate.

What is claimed is:

1. Apparatus for maintaining wire travelling therethrough isothermal for a predetermined period of time, said apparatus comprising:

rapid heating means for rapidly heating wire isothermally to a predetermined temperature over the entire cross section thereof as the wire travels through the rapid heating means; and temperature holding means disposed in-line with said rapid heating means and downstream thereof with respect to the direction of travel of the wire for maintaining the wire, after the wire is heated isothermally by said rapid heating means, at an isothermal holding temperature during the time the wire travels through the temperature holding means, said temperature holding means comprising two operatively electrically connected electrodes spaced apart from one another a predetermined distance and disposed in the apparatus so as to contact the wire travelling through the temperature holding means and form a closed circuit therewith, and voltage generating means for maintaining the wire isothermal over the length of wire between said electrodes by applying a sufficient voltage to the wire in contact with said electrodes to generate Joule's heat in the wire corresponding to the amount of heat that would tend to dissipate from the wire under unforced cooling of the wire travelling over said predetermined distance in the temperature holding means.

2. Apparatus as claimed in claim 1, wherein said rapid heating means is a direct-resistance heating means for uniformly heating the wire throughout the entire cross section thereof to said predetermined temperature.

3. Apparatus as claimed in claim 1, wherein said rapid heating means is an induction heating means for heating the surface of the wire to a temperature that is sufficiently above said predetermined temperature to cause the wire to attain said predetermined temperature prior to the wire reaching said temperature holding means.

4. Apparatus as claimed in claim 2, wherein said electrodes each comprise feeding wheels for feeding the wire through the temperature holding means, and said voltage generating means is a power source electrically connected to said feeding wheels.

5. Apparatus as claimed in claim 1, wherein said temperature holding means includes a holding furnace having a hollow annular section with the end faces thereof extending parallel to the direction of travel of the wire through the temperature holding means, a lower bulged section integral with said hollow annular section and defining an inlet and an outlet of the furnace through which the wire passes and between which a lowest wire travelling path is defined in the furnace, and heat insulation lining said hollow annular section, a plurality of electrically non-conductive and heat resistant guide rollers disposed in said annular section and over which guide rollers the wire passes, said rollers being rotatably supported by the furnace about respective axes of rotation thereof extending normally to the end faces of said annular section, each of said guide rollers having a periphery defining troughs which respectively receive the wire travelling over the guide rollers, and said guide rollers spaced from one another in said annular section at predetermined radial intervals so as to define a boundary circumscribed by the peripheries of said guide rollers that contacts said lowest wire travelling path, a wire guide unit including rollers movable into and out of said bulged section for guiding the wire onto and over said guide rollers, and wire discharge rollers disposed in said bulge section for guiding the wire passing over said guide rollers to the outlet of said furnace, and wherein said electrodes comprise rotatable wheels disposed outside the furnace proximate the inlet and the outlet of said furnace, respectively, and said voltage generating means is a transformer including an annular iron core fixed in the apparatus and extending through the annular section of said furnace around the boundary circumscribed by the peripheries of said guide rollers with end faces of said annular iron core lying normal to the direction of travel of the wire through the temperature holding means.

6. Apparatus as claimed in claim 5, wherein the rollers of said wire guide unit include a central upper roller and two freely rotatable lower rollers disposed on either side of said upper roller, respectively, said central roller having an axis of rotation disposed above said lowest wire travelling path and an outer periphery tangential to said path, and said wire guide unit further includes drive means operatively connected to said central roller for rotating said central roller, and an elevating mechanism operatively connected to said lower rollers for moving the lower rollers between a position at which the axes of rotation of the lower rollers are disposed below said lowest wire travelling path with the outer peripheries of said lower rollers tangential to said path and a position at which the outer peripheries of the lower rollers extend above said lowest wire travelling path.

7. Apparatus as claimed in claim 5, wherein said wire discharge rollers include a first freely rotatable roller having an axis of rotation disposed above said lowest wire travelling path and an outer periphery tangential to said path, and a second roller disposed closer to the outlet of said furnace than said first roller, said second roller having an axis of rotation disposed below said lowest wire travelling path and an outer periphery tangential to said path, said wire discharge rollers being electrically non-conductive and heat resistant and having outer peripheries defining troughs for receiving the wire therein.

* * * * *